United States Patent [19]

Bastian

[11] 4,274,610

[45] Jun. 23, 1981

[54] JET TAB CONTROL MECHANISM FOR THRUST VECTOR CONTROL

[75] Inventor: Thomas W. Bastian, Fullerton, Calif.

[73] Assignee: General Dynamics, Pomona Division, Pomona, Calif.

[21] Appl. No.: 924,595

[22] Filed: Jul. 14, 1978

[51] Int. Cl.[3] ..... F42B 15/18

[52] U.S. Cl. ..... 244/3.22; 60/230; 239/265.19

[58] Field of Search ..... 244/3.21, 3.22, 3.29, 244/3.1; 60/230; 239/265.19; 74/675

[56] References Cited

U.S. PATENT DOCUMENTS

| | | | |
|---|---|---|---|
| 2,969,017 | 1/1961 | Kershner | 244/3.21 |
| 2,995,319 | 8/1961 | Kershner et al. | 244/3.22 |
| 3,013,494 | 12/1961 | Chanut | 244/3.22 |
| 3,136,250 | 6/1964 | Humphrey | 244/3.21 X |
| 3,139,033 | 6/1964 | Geissler et al. | 244/3.22 |
| 3,154,015 | 10/1964 | Muller | 244/3.21 |
| 3,164,338 | 1/1965 | Cooper et al. | 244/3.21 X |
| 3,188,958 | 6/1965 | Burke et al. | 244/3.21 X |
| 3,276,376 | 10/1966 | Cubbison et al. | 244/3.22 |
| 3,286,956 | 11/1966 | Nitikman | 244/3.22 |
| 3,637,167 | 1/1972 | Froning et al. | 244/3.21 |
| 3,764,091 | 10/1973 | Crowhurst | 244/3.22 |
| 3,776,490 | 12/1973 | Weis | 244/3.21 |
| 3,786,993 | 1/1974 | Burgess et al. | 60/230 X |
| 3,986,683 | 10/1976 | Ellison | 244/3.22 X |
| 4,044,970 | 8/1977 | Moudal | 244/3.22 |

FOREIGN PATENT DOCUMENTS 1188651 4/1970 United Kingdom .

*Primary Examiner*—David H. Brown

*Attorney, Agent, or Firm*—Henry M. Bissell; Edward B. Johnson

[57] ABSTRACT

A missile jet tab actuator system for a thrust vector control coupled to aerodynamic controlled surfaces is disclosed. The device removes roll information present in commands to the aerodynamic surfaces. Only pitch and yaw information is thus supplied to the thrust vector control jet tabs. In this disclosure, the roll information is removed by a gear and slotted sleeve system. The resulting pitch and yaw output is used to drive the thrust vector control jet tabs. No separate set of independently powered actuators for such tabs is required.

9 Claims, 8 Drawing Figures

JET TAB CONTROL MECHANISM FOR THRUST VECTOR CONTROL

BACKGROUND OF THE INVENTION

1. Field of the Invention

The present invention relates to missile control systems and more particularly to a jet tab actuator system for a thrust vector control coupled to an aerodynamic surface control system.

2. Description of the Prior Art

Thrust vector control jet tabs have been utilized to enhance reaction jet, aerodynamic surface or other forms of attitude control for rocket propelled vehicles, such as missiles. During initial flight of an earth-launched rocket vehicle, the aerodynamic surfaces of the vehicle may have limited effectiveness in controlling the vehicle path. The aerodynamic surface effect may be enhanced by incorporating individual reaction motors in the tail surface control panels, as in the Maudal U.S. Pat. No. 4,044,970, assigned to the assignee of the present invention, or by directing propulsion engine exhaust against the control panels as in U.S. Pat. Nos. 3,286,956 of Nitikman, 3,276,376 of Cubbison et al, 3,013,494 of Chanut or 3,164,338 of Cooper et al.

In some cases, during vehicular travel at such altitudes and speeds at which significant control surface aerodynamic effects occur, such control may be adequate. However, at high altitudes where aerodynamic effects are reduced by low atmospheric density, attitude control may desirably be enhanced or may be available only by thrust vector control.

One method to vector thrust for control of missile flight utilizes thrust control jet tabs which are inserted into the missile exhaust flow to deflect the exhaust and thus provide control moments. Such tabs are effective for inducing pitch and yaw attitude control. However, jet tabs are ineffective in inducing roll torque. For roll control, reliance can be placed on aerodynamic surfaces because aerodynamic tail panel forces are adequate for roll attitude control above altitutes at which aerodynamic pitch and yaw attitude control is lost.

Conventional thrust vector control tab actuator systems employ separately powered actuators independent of the actuators for the movable aerodynamic surfaces. In such systems pitch, yaw and roll commands are provided to the aerodynamic control surface actuators; pitch and yaw commands are provided to the thrust vector control jet jabs. Thus at least two separate sets of actuators are required, thereby increasing the complexity and weight of the missile.

Examples of systems utilizing jet tabs or vanes in addition to aerodynamic control surfaces may be found in U.S. Pat. Nos. 2,969,017 of Kershner, 3,139,033 of Geissler et al, 3,188,958 of Burke et al, 3,776,490 of Weis, and 3,986,683 of Ellison. Other systems for controlling missile flight by resort to reaction jet forces may be found in U.S. Pat. Nos. 2,995,319 of Kershner et al, 3,136,250 of Humphrey, 3,637,167 of Froming et al, and 3,764,091 of Crowhurst.

SUMMARY OF THE INVENTION

In arrangements in accordance with the invention, conventional pitch, yaw and roll actuation is provided to the aerodynamic control surfaces. The thrust vector control jet tab (hereinafter "tab") actuation is provided through a direct coupling from the aerodynamic control surface actuator system. No separate actuators with independent power sources for the thrust vector control jet tabs are required. The same pitch and yaw commands that are provided to the aerodynamic surfaces are thus transmitted through the coupler to the tabs. Between the coupler and the tabs is a summing mechanism which removes the roll commands supplied to the aerodynamic surfaces.

Roll commands are often present in actuator command signals of a typical four-finned aft-mounted aerodynamic surface controlled rocket vehicle. These roll commands are not necessary nor desirable for tab control. In the present invention, deflection of opposite aerodynamic surface actuators are mechanically summed, removing the roll information and actuating two opposing tabs without requiring a separate set of powered actuators for the tabs. Reduction in weight and simplicity is thus achieved. The pitch and yaw commands sent to the thrust vector control system can be scaled in relation to the aerodynamic surface pitch and yaw commands by appropriate design of the dimensions of the mechanism disclosed.

The copending application of Bastian et al, Ser. No. 924,594 filed July 14, 1978, discloses a somewhat similar system providing a jet tab control mechanism. The control mechanism basically is a summing mechanism. However, in the case of the copending Bastian et al application, the summing mechanism consists basically of geared summing actuators for effecting the control of the jet tabs.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENTS

Figure 1:
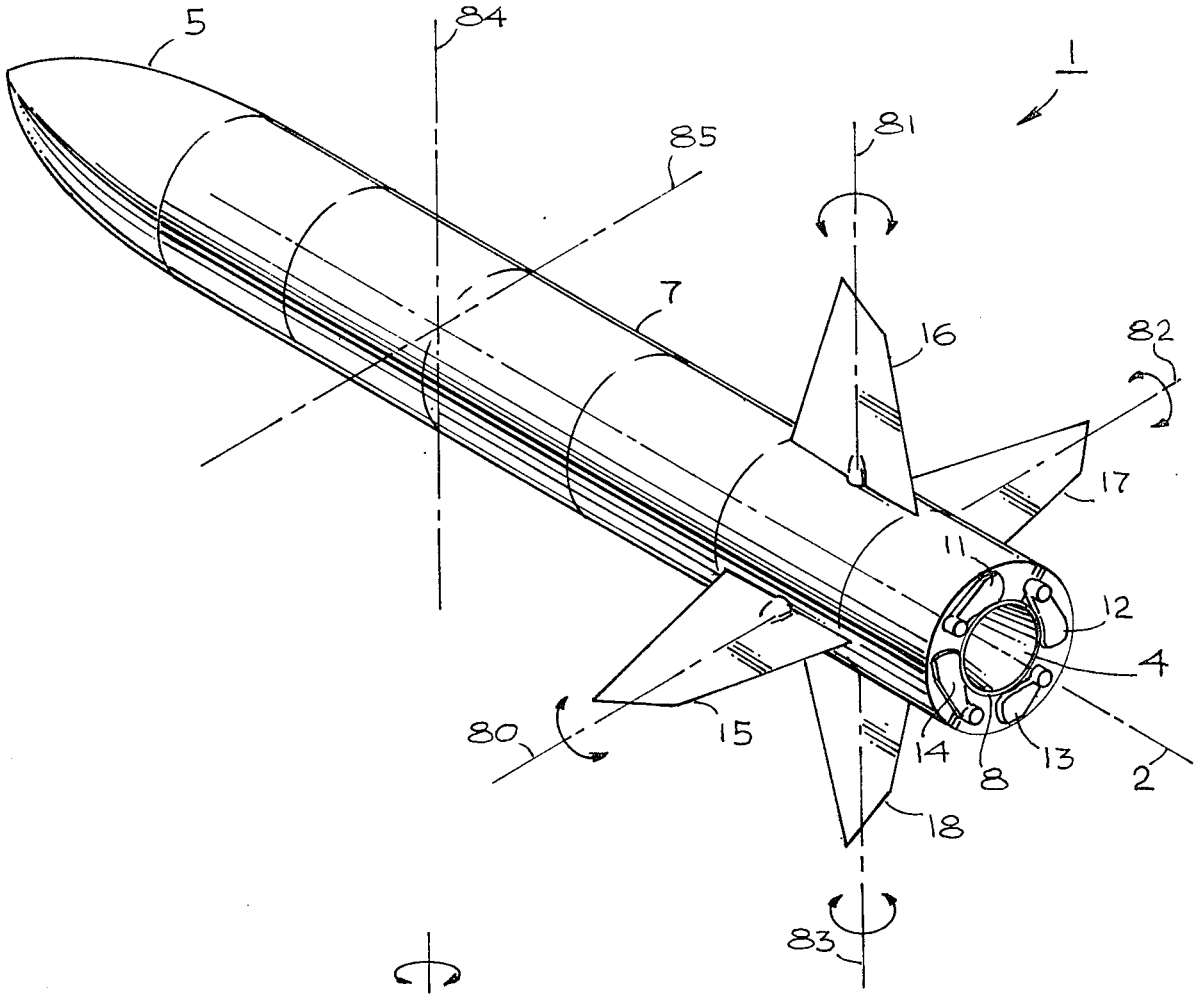
FIG. 1 is a perspective view of a missile depicting both aerodynamic control surfaces and thrust vector control jet tabs.

Referring now to the drawings and particularly to FIG. 1, there is illustrated in perspective a missile generally designated 1. The missile 1 has a rocket exhaust 4, a nose cone 5 and a main body portion 7. A rocket nozzle 8 is disposed about the exhaust 4. A central longitudinal axis 2 extends through the body of the missile 1.

The missile 1 is provided with four rotatable tabs 11, 12, 13 and 14, which are disposed about the rocket exhaust 4 and are movable through rotation about an axis parallel to the missile longitudinal axis 2, into the path of the exhaust gases. In addition, the missile 1 is provided at its rear portion with four control surfaces or fins 15, 16, 17 and 18. In a manner to be explained hereinafter, the control jet tabs 11–14 and the control surfaces 15–18 are controlled by the same actuator mechanism.

Fin or control surface 15 is mounted to body 7 for rotation about axis 80. Fins 16, 17, and 18, respectively, are mounted to body 7 for rotation about respective axes 81, 82, and 83 in the same manner as panel 15.

Figure 2:
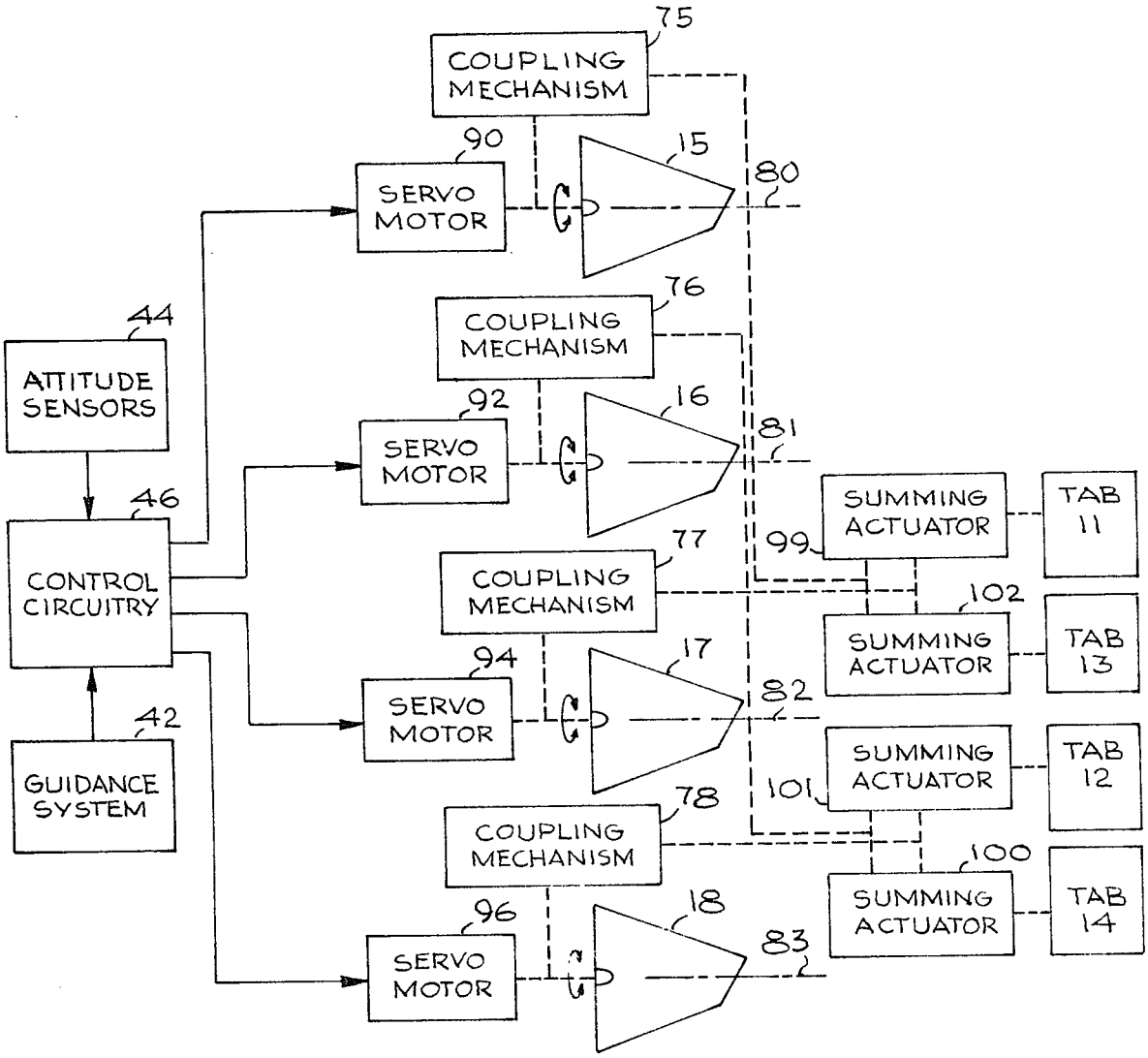
FIG. 2 is a block diagram showing the relationship of a guidance and control system to the aerodynamic control fins and to the disclosed coupled actuators for the thrust vector control jet tabs in accordance with the invention.

As shown in FIG. 2, tail fins 15, 16, 17, and 18 are controlled by servo motors 90, 92, 94, and 96, respectively, which are mounted to or preferably in body 7. Activation of servo motor 90, for example causes rotation of fin 15 about its axis 80. The other fins are moved in the same manner. The missile is shown herein in FIG. 1 with four fins mounted equidistantly about the circumference of the lower portion of body 7. In the preferred embodiment, fins 15 and 17 provide pitch attitude control around pitch axis 85; fins 16 and 18 provide yaw attitude control around yaw axis 84. Tabs 11 and 13 deflect exhaust gases to impart pitch moments while tabs 12 and 14 deflect exhaust gases to impart yaw moments. But, a different arrangement of fins and tabs may easily be utilized if required by the particular type of missile or situation involved.

FIG. 2 is a block diagram of a typical control and actuation system in which the invention is employed. Both guidance information from guidance system 42 and attitude information from attitude sensors 44 are provided to control circuitry 46 which in turn sends command signals to the fin servo motors 90, 92, 94, and 96 thus turning the four fins 15, 16, 17 and 18 as well as driving the four coupling mechanisms 75, 76, 77, and 78. Each of the four coupling mechanisms 75, 76, 77, and 78 connects to two summing actuators in a manner to be described below. Coupling mechanism 75 drives summing actuators 99 and 102. Coupling mechanism 76 drives summing actuators 100 and 101. Coupling mechanism 77 drives summing actuators 99 and 102. Coupling mechanism 78 drives summing actuators 100 and 101.

By thus coupling each fin to two summing actuators, pitch information present on each of the pitch axis fins 15 and 17 is transmitted to each of the pitch axis tabs 11 and 13. In the same manner yaw information present on each of the yaw axis fins 16 and 18 is transmitted to each of the yaw axis tabs 12 and 14.

Figure 3:
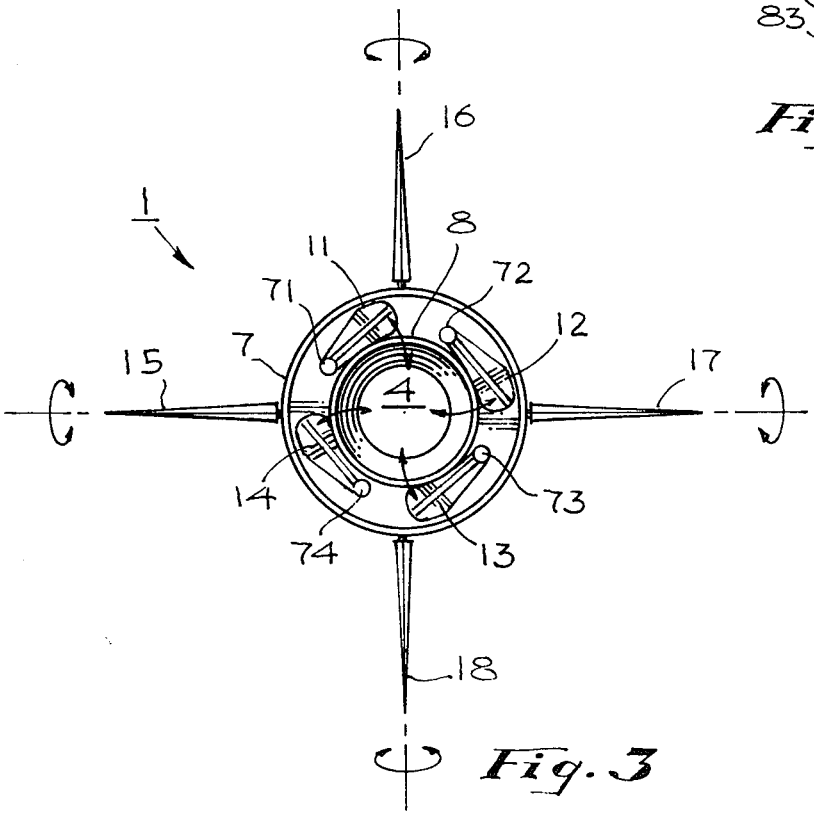
FIG. 3 is a view of the aft end of the missile looking forward and depicting the relative positions of the control surfaces and thrust vector control jet tabs.

FIG. 3 is a view from behind the missile 1 showing the relative positions of the fins 15, 16, 17, and 18 and the relative positions of the tabs 11, 12, 13, and 14 as arranged around the exhaust nozzle 8. Each of the fins 15, 16, 17, and 18 turn on their respective axes in the aerodynamic flow. Tabs 11, 12, 13, and 14 rotate on respective tab shafts 71, 72, 73, and 74 into the exhaust from nozzle 8. Each tab moves independently in accordance with the pitch and yaw control provided by the coupled actuators described within. The extent of the tab insertion into the exhaust flow determines the amount of deflection of the exhaust flow and thus the magnitude component of the induced pitch or yaw.

Figure 4:
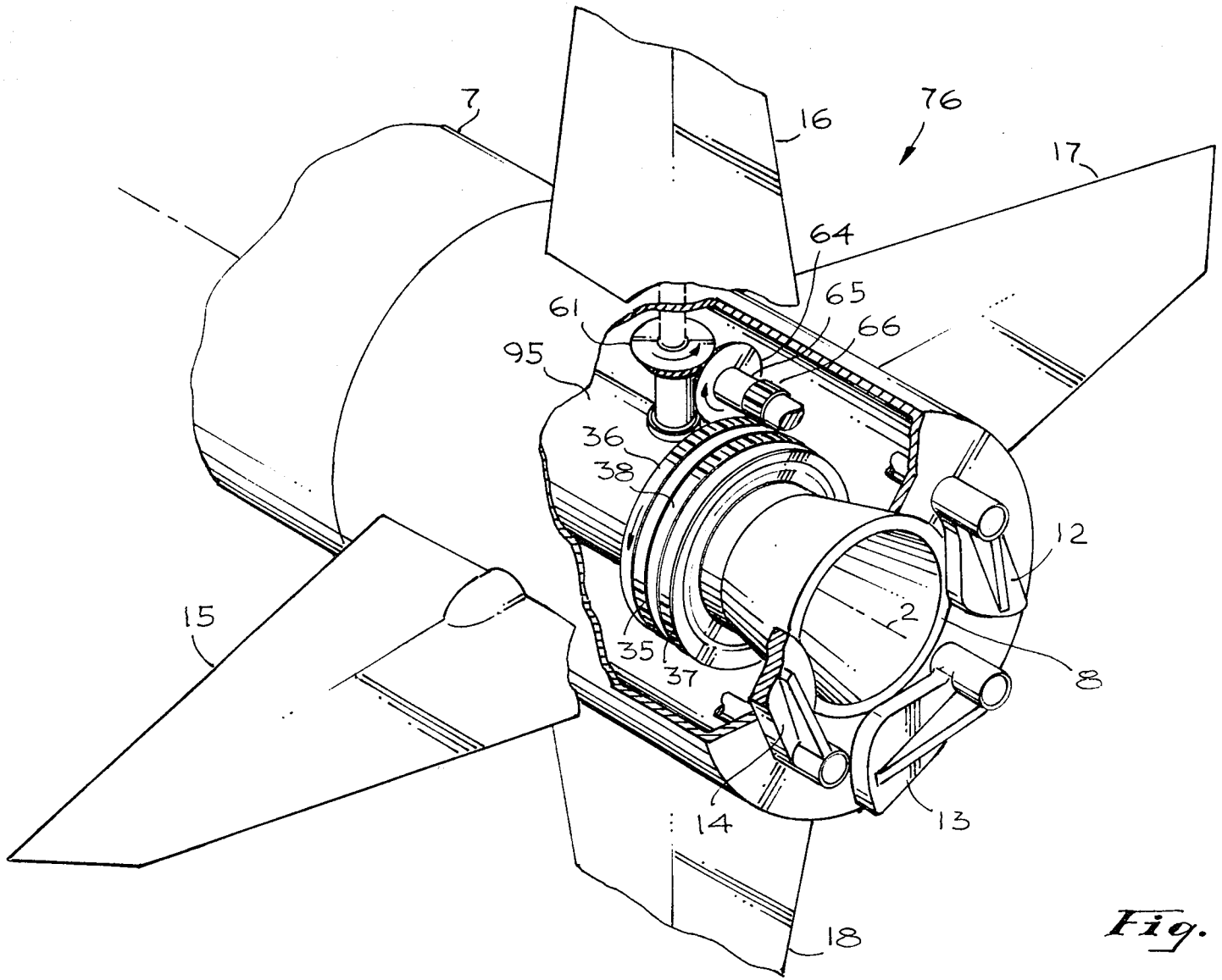
FIG. 4 is a detail view in perspective, partially broken away, of particular actuator coupling mechanism of the invention.

FIG. 4 is a detailed drawing of coupling mechanism 76. Yaw and roll commands supplied to fin 16 are provided to fin shaft drive gear 61 which transmits such commands to input shaft gear 64 turning input shaft 65. Input shaft 65 through its gear 66, drives geared ring 36. Geared rings 35, 36, 37, and 38 are placed so that all geared rings turn in planes parallel to each other. All geared rings are arranged concentric with the outer diameter of the rocket motor throat 95. Geared rings 35, 37 and 38 are driven by respective coupling mechanisms 75, 77 and 78 (see FIG. 2) which are identical to coupling mechanism 76 and are attached to respective fins 15, 17 and 18. Fin 15 is thus coupled to geared ring 35; fin 17 to geared ring 37, and fin 18 to geared ring 38.

Fin couplers 76 and 78 are arranged so that geared rings 36 and 38 turn in directions opposite to one another in response to yaw right commands and turn geared rings 36 and 38 in the opposite directions for yaw left commands. Fin couplers 75 and 77 are arranged so that geared rings 35 and 37 turn in opposite directions to one another for pitch up commands and in the other direction for pitch down commands. For a pure roll command, geared rings 36 and 38 would turn in the same direction, as would geared rings 35 and 37.

Figures 5, 5A:
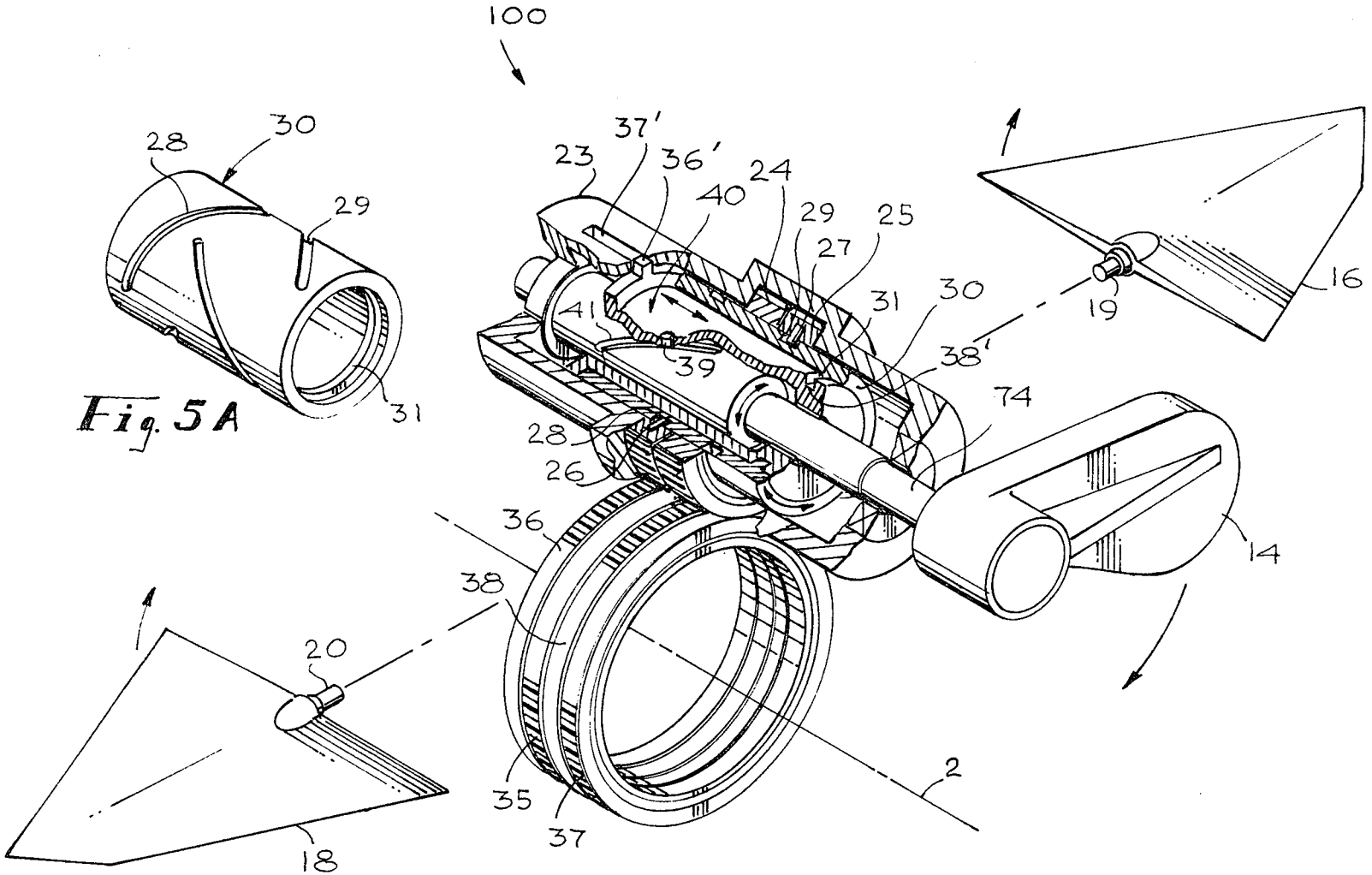
FIG. 5 is an exploded view in perspective, partially broken away, of further details of the thrust vector control jet tab summing actuator mechanism of the invention.
FIG. 5A is a view in perspective of a control sleeve used with the actuator mechanism of FIG. 5.

FIG. 5 is a detailed drawing of the summing actuator 100 for tab 14. Fins 16 and 18 turn on the respective shafts 19 and 20 as driven by the servo motors 92 and 96, which also drive fin couplers 76 and 78, respectively as shown in FIGS. 2 and 3 resulting in the rotation of geared rings 36 and 38, respectively. Thus geared ring 36 responds to commands to fin 16 and geared ring 38 responds to commands supplied to fin 18. The fins 16 and 18 are driven by their respective shafts 19 and 20 as shown particularly in FIG. 4. This is effected by drive gear 61 shown in connection with fin 16.

Geared rings 36 and 38 engage a second set of geared rings 24 and 25. Geared ring 36 drives geared ring 24 and geared ring 38 drives geared ring 25. Sleeve 30 is inside of and concentric to geared rings 24 and 25. As shown particularly in FIG. 5*a*, sleeve 30 has two guide slots 28 and 29 cut in its outer surface. Referring back to FIG. 5, geared rings 24 and 25 have pins 26 and 27, respectively, protruding from their inner surfaces which engage guide slots 28 and 29, respectively, in sleeve 30, the combination acting like a cam and cam follower. In this embodiment, slot 28 is a left-hand slot, slot 29 is a right-hand slot. Thus, rotation of the geared rings 24 and 25 in opposite directions (due to yaw commands) move the sleeve 30 forward or aft depending upon the relative directions of geared rings 24 and 25. Rotation of geared rings 24 and 25 in the same direction (due to roll commands) causes the sleeve 30 to rotate without forward or aft motion.

Keyed rider 40 rides with sleeve 30 through lip 31 and groove 38'. Keyed rider 40 is constrained from rotational movement by key 36' travelling in slot 37' cut in housing 23. Pin 39 protruding from the inner surface of keyed rider 40 engages profiled slot 41 in the increased diameter section of the tab output shaft 74. As fins 16 and 18 are commanded to yaw left, the keyed rider 40 moves forward and pin 39 moves in the profiled slot 41, forcing tab output shaft 74 to rotate and move tab 14 into the rocket motor exhaust producing an additional yaw left moment. As fins 16 and 18 yaw right, pin 39 moves aft in the profiled slot 41 resulting in retraction of tab 14.

Summing actuator 99 (see FIG. 2) which sums the input from fins 15 and 17 for tab 11, summing actuator 101 which sums the input from fins 16 and 18 for tab 12 and summing actuator 102 which sums the input from fins 15 and 17 for tab 13 are identical to summing actuator 100. Thus complete pitch and yaw information is provided to and controls the four tabs.

As a modification of the invention, profiled slot 41 may be contoured to scale the response of tab 14 according to a desired positional relationship between magnitude of yaw commands to fins 16 and 18 and the magnitude of the movement of tab 14. Such relationship could be linear or non-linear.

Figure 6A:
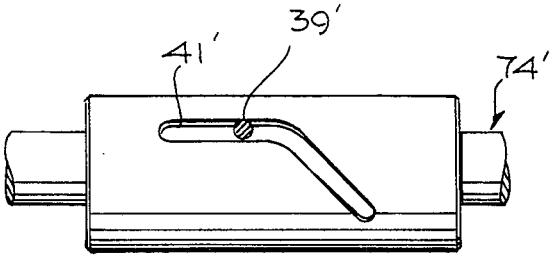
FIGS. 6A and 6B show two alternative pin and slot arrangements for the thrust vector control jet tab actuator mechanism of FIG. 5.
Figure 6B:
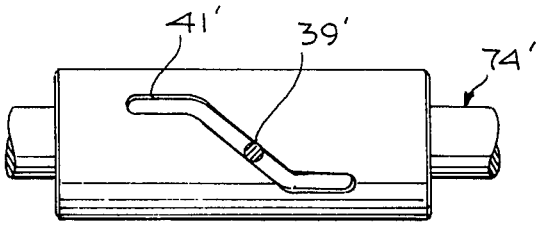

As an example of a non-linear relationship, it may be desirable to not have any thrust vector control except when the fins are near the end of their possible rotational travel. Thus, as shown in FIG. 6A, profiled slot 41' may be cut with a portion running parallel to the axis of tab shaft 74' and another connected section of the slot which curves around said axis. When pin 39' moves in the straight portion, no tab rotation will occur. Only when pin 41' is moving in the curved portion of profiled slot 41' will tab rotation occur. The profile of the curved section of the profiled slot could otherwise be varied to give a linear or further non-linear relationship between movement of the fins and tabs as shown, for example, in FIG. 6B.

Although there have been described above specific arrangements of a coupled aerodynamic surface and thrust vector control jet tab system, in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A thrust vector control system for a missile comprising:

a cylindrical missile body;

rocket propulsion means acting along the axis of the body to propel the missile;

a plurality of fins pivotably mounted external to the body, each being pivotable about an axis normal to the cylindrical surface of the missile body for aerodynamically controlling direction of the missile in flight;

a servo motor associated with each fin for controlling the angular position of the fin relative to the missile body;

control circuitry for commanding the servo motors to control the pivoting of the fins;

a plurality of thrust vector control jet tabs effective to provide pitch and yaw moments by deflecting rocket exhaust gas;

a coupler effective to transmit fin servo motor commands to the thrust vector control jet tabs; and actuator means coupled to said coupler and the tabs and containing means to rotate the thrust vector control jet tabs in response to pitch or yaw servo motor commands.

2. The control system of claim 1 wherein the tab rotating means further includes means effective to produce a non-linear relationship between the magnitude of fin pivot and the magnitude of tab rotation.

3. The control system of claim 1 wherein the tab rotating means further includes means effective to produce a linear relationship between the magnitude of fin pivot and the magnitude of tab rotation.

4. The control system of claim 1 wherein the tab rotating means further includes pin means positioned in profiled slot means effective to rotate said tabs only when the fins are near maximum pivot.

5. The control system of claim 1 wherein said coupler further includes separating means capable of removing roll information from the servo motor commands.

6. A thrust vector control system for a missile comprising:

a cylindrical missile body;

rocket propulsion means acting along the axis of the body to propel the missile;

a plurality of fins pivotably mounted external to the body, each being pivotable about an axis normal to the cylindrical surface of the missile body for aerodynamically controlling direction of the missile in flight;

a servo motor associated with each fin for controlling the angular position of the fin relative to the missile body;

control circuitry for commanding the servo motors to control the pivot angle of the fins;

a plurality of thrust vector control jet tabs capable of providing thrust moments by deflecting rocket exhaust gas;

drive means for said thrust vector control jet tabs including:

a first pair of geared rings, each ring being rotatable in response to commands provided to one of said fins;

a second pair of geared rings, each of said second rings being mated to one of said first pair of rings;

first pin means protruding from the inner surface of each of said second pair of rings;

a first hollow cylinder having guide slots cut in the outer surface thereof, each slot being engaged by one of said first pin means, said first cylinder being rotatable and axially movable within said second pair of rings in response to motion of said pin means, axial motion of said first cylinder being in response to pitch or yaw servo commands and rotation of said first cylinder being in response to roll servo commands;

a second hollow cylinder concentric to and within said first cylinder and axially movable therewith;

means for preventing rotation of said second cylinder;

second pins means protruding from the inner surface of said second cylinder; and a rotatable thrust vector control tab shaft coaxial with second cylinder and connected to a thrust vector control tab, said tab shaft having a profiled slot in the surface thereof mated to the second pin means, whereby axial motion of said second cylinder causes the thrust vector control shaft to rotate.

7. The control system of claim 6 wherein the profile of the slot in said shaft comprises a first segment parallel to the axis of said shaft, a second segment at an angle to the axis of said shaft, and third segment parallel to the axis of said shaft, said slot being effective to provide a non-linear relationship between the magnitude of the fin pivot and the magnitude of tab rotation.

8. The control system of claim 6 wherein the profile of the slot in said shaft comprises a linear slot provided on the surface of said shaft at an angle to the axis of said shaft, said slot being effective to provide a linear relationship between the magnitude of fin pivot and the magnitude of tab rotation.

9. The control system of claim 6 wherein the profile of the slot in said shaft comprises a first segment parallel to the axis of said shaft and a second segment at an angle to the axis of said shaft, said slot being effective to prevent tab rotation unless the fins are near maximum pivot.

* * * * *